US006794994B1

(12) United States Patent
Smith

(10) Patent No.: US 6,794,994 B1
(45) Date of Patent: Sep. 21, 2004

(54) AERIALLY DEPLOYABLE MARKING DEVICE

(75) Inventor: James E. Smith, Bruceton Mills, WV (US)

(73) Assignee: West Virginia University Research Corporation, Morgantown, WV (US)

( * ) Notice: Subject to any disclaimer, the term of this patent is extended or adjusted under 35 U.S.C. 154(b) by 0 days.

(21) Appl. No.: 10/124,827

(22) Filed: Apr. 18, 2002

(51) Int. Cl.[7] ..... G08G 5/00
(52) U.S. Cl. ..... 340/948; 340/908.1
(58) Field of Search ..... 340/948, 908, 340/908.1, 945, 946, 947, 950, 951, 952, 953, 972, 971, 981, 982, 983

(56) References Cited

U.S. PATENT DOCUMENTS 4,554,544 A * 11/1985 Task ..... 340/953
4,768,136 A * 8/1988 Tashjian ..... 362/84
4,969,398 A * 11/1990 Lundwall ..... 102/293
5,122,798 A * 6/1992 Kaolian ..... 340/947
5,319,365 A * 6/1994 Hillinger ..... 340/908.1
5,389,921 A * 2/1995 Whitton et al. ..... 340/933
5,400,008 A 3/1995 Toohey
5,521,595 A * 5/1996 Totten et al. ..... 340/908
5,898,363 A 4/1999 Altilio
6,299,104 B1 * 10/2001 El-Sherif et al. ..... 244/142
6,452,509 B2 * 9/2002 Ersson ..... 340/951

* cited by examiner

*Primary Examiner*—Nina Tong
(74) *Attorney, Agent, or Firm*—William F. Lang, IV; Arnold B. Silverman; Eckert Seamans Cherin & Mellott, LLC

(57) ABSTRACT

An aerially deployable position marking device includes an elongated housing, a handle secured to the housing, a ground engaging portion at or adjacent the lower end of the housing and at least one locating element which may take the form of visibility enhancing elements which are nonenergized, electrically energized, visibility enhancing devices or acoustic devices or energy releasing elements which release RF signals or other sources of energy as well as other types. Appropriate sources of energy and switch or switches may be provided.

30 Claims, 2 Drawing Sheets

AERIALLY DEPLOYABLE MARKING DEVICE

BACKGROUND OF THE INVENTION

1. Field of the Invention

This invention relates to an aerially deployable marking device and, more specifically, it relates to such a device which has features which will not only mark an area, thereby freeing aircraft from the need to hover over the same until others arrive at the scene, but also has enhancing features which facilitate more ready location of the device by ground personnel.

2. Description of the Prior Art

It has been known in connection with missions performed by various law enforcement agencies, military units and other situations to mark a specific land location employing aircraft, such as helicopters, co-acting with ground crews to pinpoint specific ground locations for the ground crew. Often, a helicopter is required to hover over the area until the ground crew arrives at the location. Examples of such needs include trailing a fleeing criminal, warning of dangerous areas such as mine fields, locating injured personnel or casualties in a battle zone or the result of terrorist action, and locating a site of illegal activity such as growing of controlled substances, such as marijuana.

U.S. Pat. No. 5,400,008 discloses a location marker which has a suitably energized flashable strobe lamp and is adapted to being deployed in a water environment. It also has a metal ring for attachment to clothing. It is not, however, designed to be aerially deployable, and as a result, has no unique weighting to facilitate landing with a particular orientation, and does not have a ground engaging element.

U.S. Pat. No. 5,898,363 discloses a portable audible beacon which has a housing with signal generating means and an acoustic transducer. The signal generating means generates an oscillating signal that is periodically interrupted by a zero signal. The fundamental frequency is said to correspond to the frequency of high auditory sensitivity to the human ear, whereas the interruption frequency is said to relate to-directionally discernable frequency to the human ear. It contains a projection to resist the unit being positioned with the speaker facing downwardly.

There remains, therefore, a very real and substantial need for a system and product for more efficiently marking a location on land by means of an aerially deployed device which will be sufficiently durable to survive the drop, will provide means for enhancing the ability of ground personnel to locate the same, and will enhance the likelihood of it engaging the ground upon contact.

SUMMARY OF THE INVENTION

The present invention has met the above-described need. It provides an aerially deployable position marking device which has an elongated housing having upper and lower ends, a handle secured to the housing, a ground engaging portion adjacent to the lower end of the housing and at least one locating element. The ground engaging portion may be a projecting spike which is adapted to penetrate the earth or other contact surface.

The locating element may be an energized or unenergized item. For example, it may be a streamer. An energized locating element may be a light, for example. A suitable battery and switch are provided for units that have to be energized.

It is an object of the present invention to provide an aerially deployable marking device which may be thrown from aircraft or otherwise thrown through the air and, under the influence of gravity, contact the ground so as to mark an area for ground personnel or other personnel.

It is a further object of the present invention to provide such a device which is adapted to physically engage the earth or other contact area.

It is yet another object of the present invention to facilitate efficient use of aircraft in various law enforcement, military and other activities such that the time the aircraft is present over a particular location of interest is minimized.

It is yet another object of the present invention to provide a durable, relatively inexpensive device of this type.

It is yet another object of the present invention to provide such a device which is reusable.

These and other objects of the invention will be fully understood from the following description of the invention with reference to the drawings appended hereto.

DESCRIPTION OF THE PREFERRED EMBODIMENTS

The device of the present invention should have adequate strength to withstand the force of impact with the ground or other underlying surface when it is dropped from aircraft or thrown from a high elevation, such as from a building, tower, mountain or tree, for example.

The internal components where switches, batteries, lights and other energized embodiments which are employed will generally be protected by suitable packing material or an internal suspension structure in any of numerous ways which will be well known to those skilled in the art. For example, among the suitable packing materials are foam rubber It and polystyrene foam.

Another important advantage of the present invention is that it provides a device which has a locating element which makes it easier for personnel to locate the device, both for purposes of efficient marking and to facilitate retrieval and reuse of the same.

Figure 1:
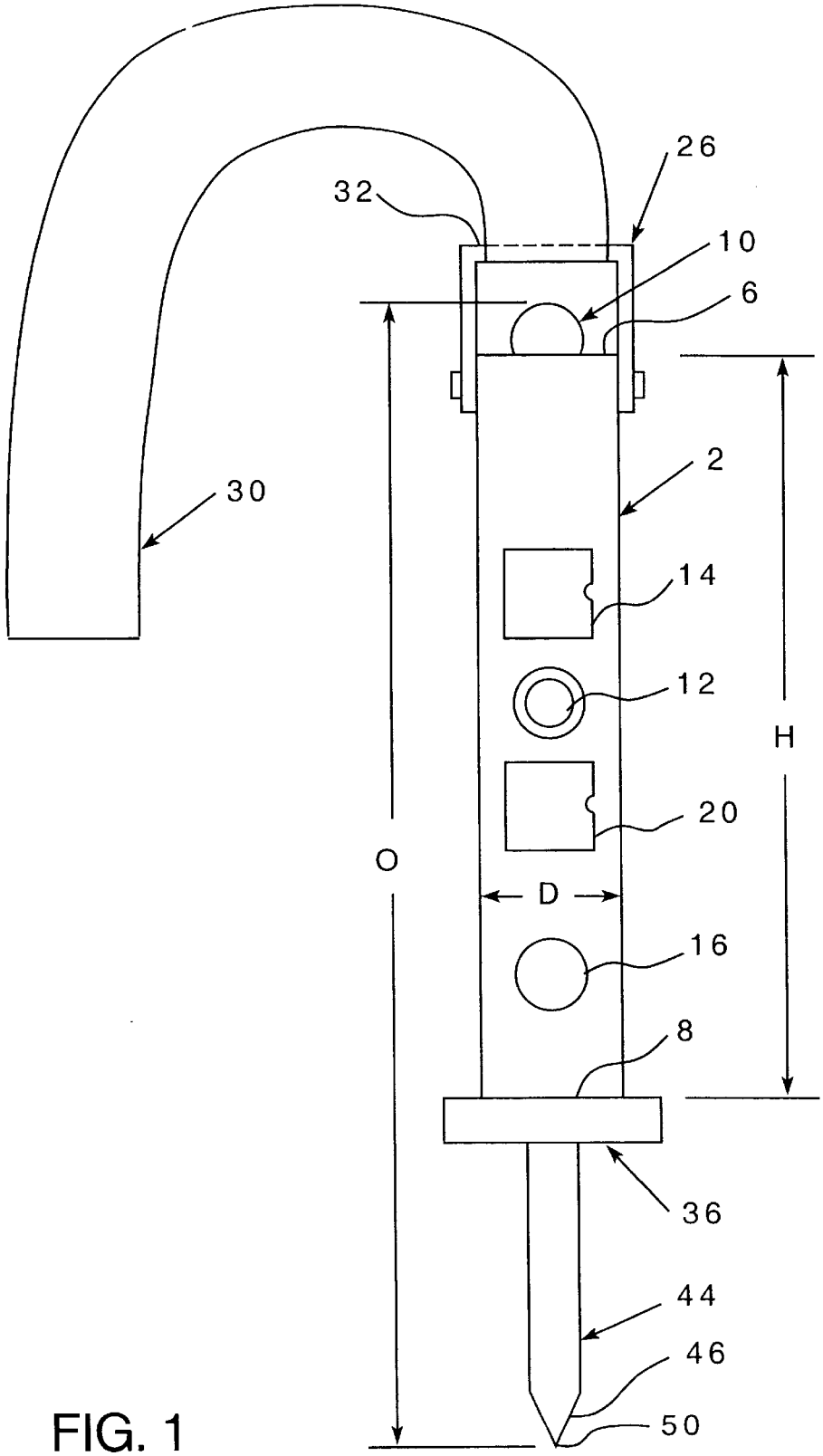
FIG. 1 is an elevational illustration of a form of aerially deployable position marking device of the present invention.

Referring again to FIG. 1, it will be seen that the aerially deployable position marking device has an elongated housing 2 which has an upper end 6 and a lower end 8. In the form shown, a locating element which is a bulb 10 which is energized by operation of a suitable switch 12 which communicates through the housing to the exterior and is powered by a battery (now shown in this view) located behind access door 14. Similarly, an acoustic sound indicator which emits sound, such as a nine volt pulsing piezo buzzer having a speaker 16, may be energized by a battery (now shown) positioned behind access door 20. The device has a handle 26 which in the form shown is generally "U" shaped to facilitate grabbing the same for manually handling and releasing it so that under the influence of gravity, it can proceed toward the earth. A streamer 30 may be ribbon-like and made of plastic or fabric. It may be of a color that contrasts readily with surrounding terrain and vegetation and may be of any desired length which does not interfere with functioning of the device. The streamer 30 is secured to the device and, in the form shown, is secured to the gripping portion 32 of the handle. At the lower end 8, there is positioned a weight 36 which serves to facilitate the device travelling toward the earth in a generally vertically oriented position such as that shown in FIG. 1. Depending from the weight 36 or passing through the same and secured to or within the housing 2 is a projecting spike member 44 which has a tapered portion 46 and terminates in a point 50 to facilitate penetration of the earth or underlying substrate. The spike member 44 may be made of steel or other material which has adequate strength. The height "H" of the housing 2 will preferably be about 15 to 20 inches for most uses. The overall height O, as measured from the tip 50 of the spike 44 to the upper portion of bulb 10 will preferably be about 20 to 30 inches for most uses. The housing external diameter "D" is preferably about 1.5 to 3 inches.

Figures 2, 3:
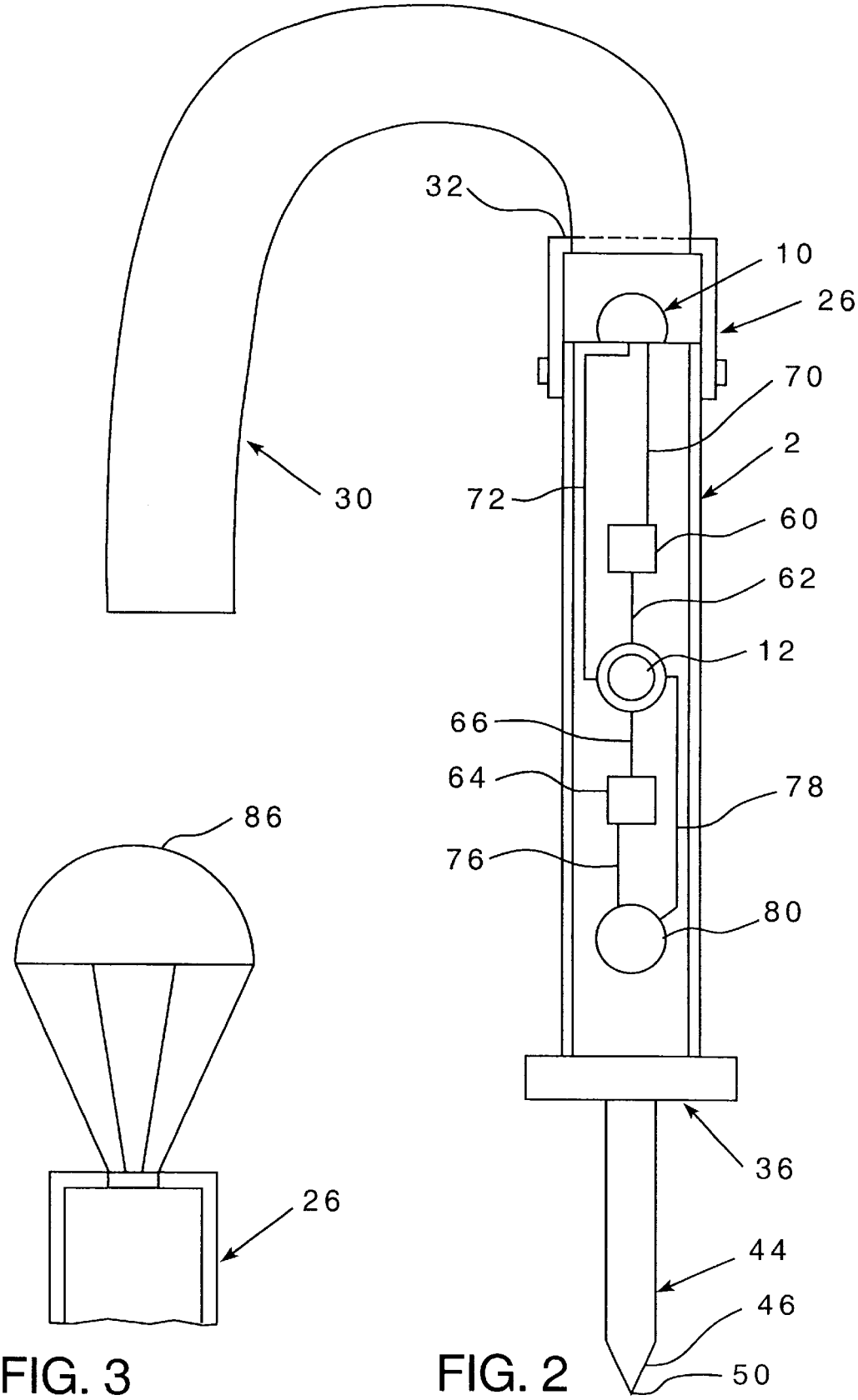
FIG. 2 is a view of the device of FIG. 1, with portions broken away for clarity of illustration.
FIG. 3 is a view of a component of an aerially deployable position marking device of the present invention which serves to facilitate efficient movement through the air.

Referring to FIG. 2, which has a portion of the housing 2 broken away to show some interior components. Like numbers will be employed as in FIG. 1 with respect to like components. The switch 12 is connected to battery 60 through electrical lead 62 and to battery 64 through electrical lead 66. Electrical lead 70 connects the battery 60 with the light 10 and electrical lead 72 connects switch 12 with the light 10. Electrical lead 76 connects the battery 64 with the piezo buzzer 80 which is operatively associated with speaker 16, and electrical lead 78 connects switch 12 with piezo buzzer 80. It will be appreciated by depressing switch 12 both the lamp 10 and the piezo buzzer 80 will be energized.

It will be appreciated that both electrically energized and nonenergized locating elements facilitate location of the device on the ground and, depending upon the timing and positioning of the personnel, may also facilitate their observing the travel from the time of release until ground engagement. Such an advantage may be particularly helpful during night release. It will be appreciated that additional locating elements may be employed or less than those identified herein. For example, in lieu of or in addition to the audible or acoustic piezo buzzer 16, an RF transmitter may be employed with a suitable antenna. The housing may function as the antenna.

In operating the device, one would normally engage it by handle 26, push switch 12 if there are electrically energizable components and then drop or throw the device.

FIG. 3 illustrates a further refinement wherein a handle, such as 26, has a parachute 86 attached thereto. This serves as a locating element, as it enhances visibility on the way down and after landing. It also tends to reduce the velocity at which the device moves under the influence of gravity toward the ground. The size of the parachute 86 will influence the degree to which it retards the rate of descent and accuracy in hitting the target area. The smaller the parachute, the less the retarding effect and the greater the accuracy.

The device may be made of any material of suitable strength and durability which is economically feasible. For example, aluminum and steel are among the materials which may be employed advantageously.

The housing may be tubular and may have any desired cross sectional shape, such as round or square, for example.

It will be appreciated, therefore, that the invention provides an improved means of aerially deploying positioning devices and thereby freeing aircraft for other activities or a return to base. Also, the devices preferably contain locating elements which enhance the visibility of the same both during descent and after landing.

Whereas particular embodiments have been described herein for purposes of illustration, it will be evident to those skilled in the art that numerous variations of the details may be made without departing from the invention as defined in the appended claims.

I claim:

1. An aerially deployable position marking device comprising an elongated housing having an upper end and a lower end, a handle secured to said housing, a ground engaging portion at or adjacent the lower end of said housing, at least one locating element; a speed reducing element secured to said housing or said handle to reduce the rate of descent of said device through the air; and the position marking device being structured for deployment from an aircraft, whereby said marking device will provide its marking function during descent to a target area and upon striking the target area without requiring secondary action.

2. The aerially deployable position marking device of claim 1, including said ground engaging portion having a projecting spike-like element, whereby said spike-like element will enhance the likelihood of said device engaging the ground.

3. The aerially deployable position marking device of claim 1, including a weighted lower portion of said device having sufficient weight to facilitate said device being generally vertically oriented with said ground engaging portion oriented generally downwardly as said device travels through the air.

4. The aerially deployable position marking device of claim 3, including said weighted lower portion having a weighted element disposed above said ground engaging portion.

5. The aerially deployable position marking device of claim 1, including said handle being secured to an upper portion of said housing.

6. The aerially deployable position marking device of claim 1, including said locating element having a visibility enhancing portion.

7. The aerially deployable position marking device of claim 6, including said visibility enhancing portion being at least one streamer structured to make said device more visible.

8. The aerially deployable position marking device of claim 1, including said speed reducing element being a parachute.

9. The aerially deployable position marking device of claim 1, including said locating element being electrically energized.

10. The aerially deployable position marking device of claim 9, including said locating element being a light.

11. The aerially deployable position marking device of claim 9, including said locating element being an acoustic element.

12. The aerially deployable position marking device of claim 9, including said locating element being an RF signal source.

13. The aerially deployable position marking device of claim 1, including an electrical switch secured to said housing.

14. The aerially deployable position marking device of claim 13, including at least one battery operatively associated with said switch for energizing said electrically energized locating element.

15. The aerially deployable position marking device of claim 1, including said device having an overall height of about 20 to 30 inch.

16. The aerially deployable position marking device of claim 1, including said housing having a tubular metal body.

17. An aerially deployable position marking device comprising an elongated housing having an upper end and a lower end;

a handle secured to said housing;

a parachute secured to said housing or said handle to reduce the rate of descent of said device through the air;

a ground engaging portion at or adjacent the lower end of said housing, said ground engaging portion having a projecting spike-like element; and at least one locating element, whereby said marking device will provide its marking function during descent, to a target area and upon striking the target area without requiring secondary action and whereby said spike-like element will enhance the likelihood of said device engaging the ground.

18. The aerially deployable position marking device according to claim 17, further comprising a weighted lower portion of said device having sufficient weight to facilitate said device being generally vertically oriented with said ground engaging portion oriented generally downwardly as said device travels through the air.

19. The aerially deployable position marking device according to claim 18, wherein said weighted lower portion includes a weighted element disposed above said ground engaging portion.

20. The aerially deployable position marking device of claim 17, wherein said handle is secured to an upper portion of said housing.

21. The aerially deployable position marking device of claim 17, wherein said locating element includes a visibility enhancing portion.

22. The aerially deployable position marking device of claim 17, wherein said visibility enhancing portion includes at least one streamer structured to make said device more visible.

23. The aerially deployable position marking device of claim 17, wherein said locating element is electrically energized.

24. The aerially deployable position marking device of claim 23, wherein said locating element is a light.

25. The aerially deployable position marking device of claim 23, wherein said locating element is an acoustic element.

26. The aerially deployable position marking device of claim 23, wherein said locating element is an RF signal source.

27. The aerially deployable position marking device of claim 23, including an electrical switch secured to said housing.

28. The aerially deployable position marking device of claim 27, including at least one battery operatively associated with said switch for energizing said electrically energized locating element.

29. The aerially deployable position marking device of claim 17, wherein said device has an overall height of about 20 to 30 inches.

30. The aerially deployable position marking device of claim 17, wherein said housing has a tubular metal body.

* * * * *